US009394809B2

(12) United States Patent
Gruber et al.

(10) Patent No.: US 9,394,809 B2
(45) Date of Patent: Jul. 19, 2016

(54) HYDRAULIC VALVE FOR CAM PHASER

(71) Applicant: Hilite Germany GmbH, Marktheidenfeld (DE)

(72) Inventors: Erik Gruber, Marktheidenfeld (DE); Michael Oppel, Neuendorf (DE); Juergen Goll, Collenberg (DE)

(73) Assignee: Hilite Germany GmbH, Marktheldenfeld (DE)

( * ) Notice: Subject to any disclaimer, the term of this patent is extended or adjusted under 35 U.S.C. 154(b) by 0 days.

(21) Appl. No.: 14/622,887

(22) Filed: Feb. 15, 2015

(65) Prior Publication Data

US 2015/0240673 A1 Aug. 27, 2015

(30) Foreign Application Priority Data

Feb. 27, 2014 (DE) ..... 10 2014 102 617

(51) Int. Cl.
*F01L 1/34* (2006.01)
*F01L 1/344* (2006.01)

(52) U.S. Cl.
CPC ..... *F01L 1/3442* (2013.01); *F01L 2001/34423* (2013.01); *F01L 2001/34426* (2013.01)

(58) Field of Classification Search
CPC ..... F01L 2001/34426; F01L 2001/3443; F01L 2001/34433
See application file for complete search history.

(56) References Cited

U.S. PATENT DOCUMENTS

2010/0288384 A1* 11/2010 Hoppe ..... F01L 1/344 137/843

FOREIGN PATENT DOCUMENTS

| | | | |
|---|---|---|---|
| DE | 102008006179 | A1 | 7/2009 |
| DE | 102008036182 | A1 | 2/2010 |
| DE | 102008036876 | A1 | 4/2010 |
| DE | 102009043154 | A1 | 4/2010 |
| WO | WO2009089960 | A1 | 7/2009 |

* cited by examiner

*Primary Examiner* — Thomas Denion
*Assistant Examiner* — Daniel Bernstein
(74) *Attorney, Agent, or Firm* — Von Rohrscheidt Patents

(57) ABSTRACT

A hydraulic valve for a cam phaser including a valve housing with a longitudinal axis and a valve piston that is axially moveable along the longitudinal axis, wherein the valve piston opens and closes a first operating connection of the valve housing and a second operating connection of the valve housing, wherein the first operating connection and the second operating connection are axially offset from one another; and a supply connection of the valve housing which is used for supplying the hydraulic valve with a hydraulic fluid fed by a feed device, wherein the hydraulic valve is configured to be flowed through by the hydraulic fluid on different paths controlled by a flow permeable channel system of the valve piston, and wherein a check valve opening and closing an inflow channel is arranged in the hydraulic valve in the inflow channel of the valve housing.

11 Claims, 5 Drawing Sheets

HYDRAULIC VALVE FOR CAM PHASER

RELATED APPLICATIONS

This applications claims priority from and incorporates by reference German patent application 10 2014 102 617.9 filed on Feb. 27, 2014.

BACKGROUND OF THE INVENTION

The present invention relates to a hydraulic valve for a cam phaser.

Hydraulic valves for cam phasers in general are well known. The hydraulic valve includes a flowable valve piston which is received axially moveable in a valve housing of the hydraulic valve. The valve housing is configured with flowable channels so that a hydraulic fluid can flow through these channels and can flow in and out of the valve housing on different flow paths through a channel system configured in the valve piston. Typically the valve housing includes a flowable first operating connection, a flowable second operating connection and a flowable supply connection. The first operating connection and the second operating connection are connected with the cam phaser and the hydraulic fluid is feedable into the hydraulic valve and also out of the hydraulic valve through these connections. In order to supply the hydraulic valve with the hydraulic fluid fed by a feed device the valve housing includes the supply connection. In order to use cam shaft switching moments check valves are positioned in the flow paths of the operating connections, either in the valve housing or in the valve piston. Furthermore a check valve is configured in a flow path of the supply connection so that the hydraulic fluid can flow through the supply connection into the valve housing or into the valve piston, however, so that an exit of the hydraulic fluid through the flow path of the supply connection is blocked. Due to the check valves the hydraulic fluid in the hydraulic valve is controllable as a function of pressure.

Thus, for example the publication document DE 10 2009 043 154 A1 discloses a hydraulic valve with a check valve configured as a ball check valve which is arranged in the flow path of the supply connection between the supply connection and the feed device.

From the publication DE 10 2008 006 179 A1 a hydraulic valve is known which includes a support sleeve for the valve piston which is axially moveable in the valve housing. Openings are provided in the support sleeve which are configured for flowing through the hydraulic valve in combination with the flowable channels in the valve housing. A woven filter material is provided between the valve housing and the support sleeve. Typically the hydraulic fluid is filtered in a supply channel to which the supply connection is associated, wherein the filtering is performed with a respective separation device, for example an oil separator sleeve. The woven filter material is provided for filtering the hydraulic fluid for example for retaining chips which can be produced when mounting the separation device. Chips that reach the valve housing can on the one hand side impede movability of the valve piston, on the other hand side they can block the channels and the channel system so that the hydraulic valve cannot perform its function any more. A check valve configured as a ball check valve is arranged in the section of the supply connection in order to prevent a back flow of the hydraulic fluid from the valve piston into the supply connection.

The publication document DE 10 2008 036 182 A1 discloses a hydraulic valve which is provided for simplifying a supply to cam bearings. In order to block a hydraulic fluid outflow from the hydraulic valve into the supply channel of the cam bearings a check valve configured as a ball check valve is arranged at a face of the hydraulic, which face is oriented towards the cam shaft.

An improvement of responsiveness shall be achieved by the hydraulic valve with two spring loaded check valves that can be derived from publication document DE 10 2008 036 876 A1. The two check valves are provided for blocking an outflow of the hydraulic fluid in a direction towards the feed device. Using the two check valves contrary to just using one check valve shall safely prevent a back flow of the hydraulic fluid. Furthermore the two check valves facilitate adapting an effective pass through cross section to the respective conditions for quickly loading the hydraulic valve and thus to provide improved responsiveness of the hydraulic valve. This means for example operating an internal combustion engine including the cam shaft at high speeds feeds a correspondingly large hydraulic fluid flow which requires a large effective pass through cross section for quickly loading the hydraulic valve. By comparison a small effective pass through cross section is required for achieving a quick loading at low speeds.

A hydraulic valve that is configured as a check valve but not as a ball check valve can be derived from the publication document WO 2009/089 960 A1. In order to obtain quick response of the hydraulic valve and an increase of the adjustment speed of the cam phaser a closure element of the check valve in a flow cross section of the supply connection is disclosed which closure element is configured disc shaped and arranged in an inflow channel of the hydraulic valve for the supply connection. The disc for opening and closing the inflow channel includes a closure element which is supported at the disc in a spring elastic manner. A disc is disclosed with a ring that is configured with spring elements, wherein the closure element is arranged within the ring. The closure element is integrally connected with the ring in one piece. The spring elements are illustrated with groove shaped channels completely penetrating the disc along its thickness so that a spring element that is respectively configured between two channels is moveable in a spring elastic manner along a longitudinal axis of the disc. The idea is to achieve quicker closing or opening of the check valve due to a greater effective inflow surface and lower mass inertia compared to a ball check valve. An inflow of hydraulic fluid from the supply connection into the valve piston is provided through the spiral or wave arc shaped channels which are simultaneously used for providing the spring elements and through a lift off of the closure element from the inflow channel, however so that the disc is fixated at its outer circumference.

BRIEF SUMMARY OF THE INVENTION

Thus, it is an object of the present invention to provide a hydraulic valve for a cam phaser which assures safe closure and sufficient supply for the hydraulic valve at low camshaft speeds and also at high camshaft speeds and which has a simple and cost effective configuration.

The object is achieved according to the invention by a hydraulic valve for a cam phaser including a valve housing with a longitudinal axis and a valve piston that is axially moveable along the longitudinal axis, wherein the valve piston opens and closes a first operating connection of the valve housing and a second operating connection of the valve housing, wherein the first operating connection and the second operating connection are axially offset from one another; and a supply connection of the valve housing which is used for supplying the hydraulic valve with a hydraulic fluid fed by a feed device, wherein the hydraulic valve is configured to be flowed through by the hydraulic fluid on different paths controlled by a flow permeable channel system of the valve piston, and wherein a check valve opening and closing an inflow channel is arranged in the hydraulic valve in the inflow channel of the valve housing which inflow channel is associated with the supply connection, wherein the check valve includes a disc shaped flow permeable first closure element with a first pass through opening and a spring element, characterized in that the check valve includes a flow permeable second closure element with a second pass through opening, wherein the first pass through opening is arranged opposite to a non flow permeable second outer section of the second closure element, and wherein the second pass through opening is arranged opposite to a non flow permeable first inner section of the first closure element, so that a relative movement between the first closure element and the second closure element causes an opening or closing of the check valve.

Advantageously embodiments with useful and non trivial variations of the invention are provided in the dependent claims.

The hydraulic valve according to the invention for a cam phaser with a valve housing and a valve piston that is moveable along a longitudinal axis of the valve housing includes a check valve which is received in a flow channel of the valve housing upstream of the valve piston and downstream of a supply connection of the valve housing. The supply connection is used for supplying hydraulic fluid to the hydraulic valve. The check valve is arranged in the supply channel so that the supply channel is openable or closeable by the check valve so that the hydraulic fluid cannot flow back from the inflow channel towards the supply connection.

The check valve includes a flowable disc shaped first closure element including at least a first pass through opening and a flowable second closure element including at least a second pass through opening. Since both closure elements include a pass through opening it is required for achieving a sealing effect or closing the check valve that the closure elements are arranged so that the first pass through opening is arranged opposite to a non flowable first section of the second closure element and the second pass through opening is arranged opposite to a non flowable second section of the first closure element so that opening or closing the check valve is performed based on a movement of the two closure elements relative to each other. The two accordingly configured closure elements provide a secure closure of the check valve in a simple manner since the pass through openings of the two closure elements can be closed by the respective opposite closure element as a result of a relative movement. Put differently this means that in case the two closure elements move towards each other a sealing contact between the two closure elements can be established, wherein the pass through openings are closed due to their positioning.

Opening the check valve can be performed rather quickly since the pass through openings are released already for a small movement of the two closure elements relative to one another where they move away from each other so that hydraulic fluid can flow from the first pass through opening between the first closure element and the second closure element already for a small displacement of the two closure elements from each other so that the hydraulic fluid flows through the second closure element into the valve piston.

In a second embodiment of the hydraulic valve according to the invention the first pass through opening is arranged in an outer section of the first closure element and the second pass through opening is configured in a center of the closure element.

Compared to the check valves known in the art the advantage is that on the one hand side an assured sealing effect is obtainable due to the pass through openings that are arranged relative to another accordingly and on the other hand side it is possible to release a sufficiently large flow cross section as quickly as possible so that a quick response of the hydraulic valve is provided.

Advantageously the first closure element is configured independently from the second closure element so that an uncomplicated and thus cost effective production can be implemented.

In another embodiment of the hydraulic valve according to the invention the first pass through opening is configured in a first outer section of the first closure element and the second pass through opening is configured in a second inner section of the second closure element. This has the advantage that the hydraulic fluid when flowing into the valve piston from the second pass through opening does not go through any or almost no change in flow direction so that flow loses are largely prevented so that also this configuration facilitates a quick response of the hydraulic valve.

It is another advantage of the solution according to the invention that disc shaped closure elements with the accordingly arranged pass through openings can be produced in a cost effective manner. Thus, the closure elements can be made for example from a sheet material which can be worked in a simple manner. The pass through openings can be introduced into the disc through a stamping method simultaneously with fabricating the disc.

Another advantage of the disc shaped closure elements is little wear of components that contact each other during operations when closing the check valve due to a greater contact or impact surface compared to the known check valves.

An axial movement of one of the two closure elements, advantageously of the second closure element arranged proximal to the valve piston is easily supported by a spring element which is advantageously configured as a coil spring. Thus, the spring element only has a supporting effect in that it causes on the one hand side a quicker closure and on the other hand side a safe closure since already a pressing force impacting the second closure element due to pressure spikes at the valve piston achieves an axial movement of the second closure element in a direction of the first closure element. When the second closure element reaches the first closure element the spring element additionally imparts a pressure force for safe closure.

Overall the hydraulic valve according to the invention is characterized by a simple configuration of its check element so that simple and quick assembly can be provided. Axially securing the spring element is provided by a second shoulder configured in the hollow cylinder and axially securing the first closure element is obtained in a simple manner with a first shoulder provided in the inflow channel and a retaining ring received in an inflow channel in a ring groove. The shoulders are thus produced e.g. through internal turning. This means the check valve of the hydraulic valve according to the invention is characterized by simple production of the closure elements and simple assembly, and the hydraulic valve is influenced very little by its installation position.

The first pass through opening is configured groove shaped over a circular circumference and the second pass through opening is configured circular so that a large effective flow cross section of the check valve is achievable so that a quick response of the hydraulic valve can be provided even for high engine speeds since a sufficient amount of the hydraulic fluid can flow in a respectively required short time period through the pass through openings into the supply channel of the valve piston.

Due to the configuration of the check valve sensitivity with respect to contamination is greatly reduced. Thus, the check valve can be adjusted in the same simple manner that is used for mounting. Materials optimization facilitates further improvement of the reaction time and leak tightness. Overall the check valve is characterized by a low loading of the disc shaped closure elements and overall of the components that are configured adjacent to the closure elements since only the second closure element has to be moved in addition to the spring element.

Secure closure of the check element prevents an opposite pressure on a filter that is provided upstream of the check element in the flow path of the supply connection, in particular a sieve, so that a loading of the sieve is reduced and its service life is extended.

BRIEF DESCRIPTION OF THE DRAWINGS

Further advantages, features and details of the invention can be derived from a subsequent description of advantageous embodiments with the reference to drawing figures. The features and feature combinations recited in the preceding description and the features individually recited in the subsequent figure description or illustrated in the figures are not only useable in the respectively provided combination but are also useable by themselves or in other combinations without extending beyond the scope of the invention. Identical or functionally equivalent elements have identical reference numerals. For reasons of clarity it is possible that the elements are not provided with respective reference numerals in all figures, while maintain their association, wherein.

DETAILED DESCRIPTION OF THE INVENTION

A cam phaser that is not illustrated in more detail facilitates changing opening and closing times of gas control valves of an internal combustion engine which is not illustrated in more detail. Thus, the cam phaser according to the invention continuously adjusts a relative angular position of a cam shaft of the internal combustion engine relative to a crank shaft of the internal combustion engine wherein the cam shaft and the crank shaft are not illustrated in more detail and wherein the cam shaft is not rotated relative to the crank shaft.

Figure 1:
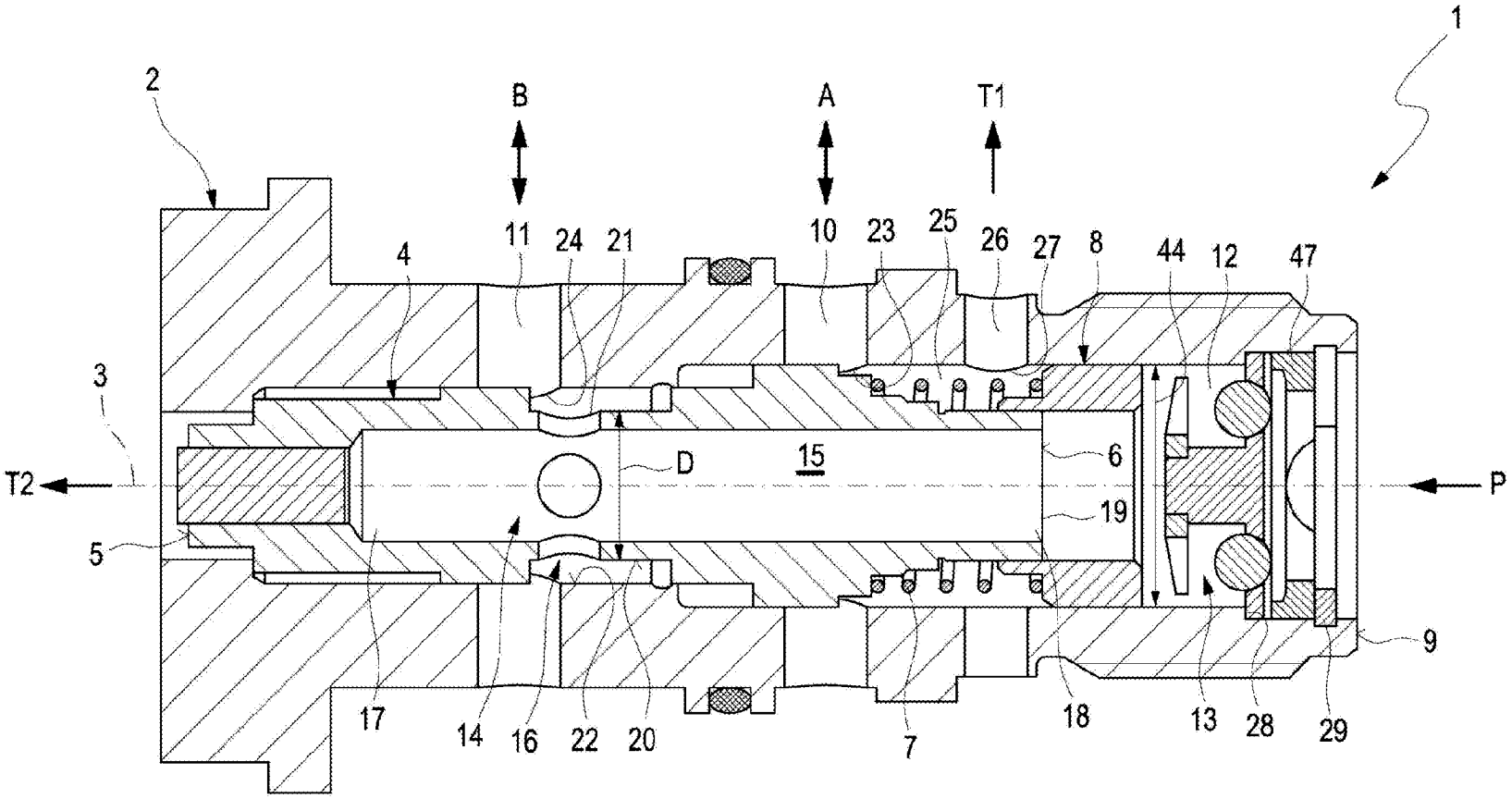
FIG. 1 PRIOR ART
FIG. 1 illustrates a longitudinal sectional view of a hydraulic valve for a cam phaser with a check valve configured as a ball check valve that is known in the art.

Rotating the cam shaft moves the opening and closing times of the gas control valves so that the internal combustion engine produces optimum power at a respective speed. Controlling the cam phaser is typically provided by an electronic control unit which controls an inflow and an outflow of hydraulic fluid in pressure chambers provided in the cam phaser based on parameters of the internal combustion engine. A hydraulic valve 1 controlled by electrical signals from a control unit is used for controlling inflow and outflow of the hydraulic fluid, wherein the hydraulic valve according to the prior art as illustrated in FIG. 1 is configured with a check valve configured as a ball check valve.

The hydraulic valve 1 includes a valve housing 2 and a valve piston 4 that is axially moveable along a longitudinal axis 3 of the valve housing 2. In order to move the valve piston 4 a first face 5 of the valve piston 4 that is oriented away from the internal combustion engine is closed so that a plunger that is not illustrated in more detail of an electromagnetic linear actuator that is not illustrated in more detail can contact the first face 5. Providing power to the linear actuator leads to an axial movement of the valve piston 4 towards the internal combustion engine, wherein a retaining element 7 arranged at a second face 6 of the valve piston 4 which is configured oriented away from the first face 5 imparts a reset force upon the valve piston 4 against which reset force the valve piston 4 has to be moved. The retaining element 7 configured in this embodiment as a compression coil spring is supported at a hollow cylinder 8 which is arranged in the portion of the second face 6 with a press fit and non moveable in the valve housing 2.

The valve piston 4 is configured flowable and includes a channel system 14 with a supply channel 15 and a channel groove 16 intersecting the supply channel. The supply channel 15 extends along a longitudinal axis of the valve piston 4 which longitudinal axis is configured coaxial to the longitudinal axis 3, wherein the supply channel 15 is closed at a first channel end 17 oriented towards the first face and open at a second channel end 18 oriented towards the second face 6 so that hydraulic fluid can flow into the supply channel 15 through an inlet opening 19 of the valve piston 4 configured at the second channel end 18.

The channel group 16 is configured as intersecting bore holes, wherein each bore hole extends completely over a diameter D of the valve piston 4 and forms two respective outlet openings 21 at an enveloping surface 20 of the valve piston 4. The bore holes are arranged star shaped, wherein they form a joint intersection surface which is arranged flowable in the supply channel 15.

The valve housing 2 which is configured bushing shaped includes a supply connection P, a first operating connection A, a second operating connection B, a first tank access T1 and a second tank access T2 which are respectively configured flowable. The first operating connection A and the second operating connection B are connected with accordingly associated pressure chambers of the cam phaser so that the hydraulic fluid can load the pressure chambers in a manner controlled by the hydraulic valve 1.

A first channel 10 in the valve housing 2 is associated with the first operating connection A and a second channel 11 in the valve housing 2 is associated with the second operating connection B, wherein the operating connections facilitate loading the channels 10, 11 with the hydraulic fluid flowing through the hydraulic valve using a first opening 23 and a second opening 24 configured at an inner surface 22 of the valve housing 2, which inner surface is oriented towards the valve piston 4.

Depending on a selected direction of rotation the hydraulic fluid flows in or out of the pressure chambers. Thus, for example in the position of the valve piston illustrated in FIG. 1 the pressure chambers associated with the operating connection B are loaded with the hydraulic fluid. In this position of the valve piston 4, the hydraulic fluid flows out of the supply connection P through a check valve 13 arranged in an inflow channel 12 of the valve housing 2, which inflow channel is configured between the supply connection P and the hollow cylinder 8, and through the hollow cylinder 8 through the inlet opening 19 into the supply connection 15.

The outlet openings 21 at least partially cover the second opening 24 so that the hydraulic fluid can flow out of the supply channel 15 through the outlet openings 21 and the second opening 24 into the second channel 11 through the second operating connection B into the respective pressure chambers.

The pressure chambers associated with the second operating channel B are thus loaded with the hydraulic fluid. This has the effect that hydraulic fluid exits the pressure chambers associated with the first operating connection A, wherein the hydraulic fluid flows from the first channel 10 through its first opening 23 and a first gap 25 arranged between the enveloping surface 20 and the inner surface 22 into a third channel 26 which includes a third opening 27 arranged at an inner surface 22 wherein the third channel 26 is connected with the first tank access T1 for relief, this means for draining the hydraulic fluid.

The second tank access T2 through which the hydraulic fluid can flow from the second channel 11 when the valve piston 4 is positioned accordingly is arranged in a portion of the cam phaser downstream of the first face 5.

In a non-illustrated additional position of the valve position 4, the valve piston 4 is axially moved in a direction towards the internal combustion engine so that the first gap 25 is closed whereas an axially opposite second gap is configured between the first opening 23 and the enveloping surface 20, wherein the outlet openings 21 now at least partially cover the first opening 23. Through this second gap the hydraulic fluid can flow through the outlet openings 21 out of the supply channel 15 into the first opening 23 and thus into the first channel 10. From the first channel 10 the hydraulic fluid flows through the first operating connection A into the pressure chambers associated with the first operating connection A wherein the pressure chambers are loaded with the hydraulic fluid.

As a consequence of this loading hydraulic fluid exits the pressure cavities associated with the second operating connection B wherein the hydraulic fluid flows out of the second channel 11 through its second opening 24 and a third gap which is configured between the enveloping surface 20 and the inner surface 22 so that the hydraulic fluid eventually flows into the second tank access T2.

The supply connection P is configured to be connected with an oil pump which is not illustrated in more detail so that the hydraulic valve 1 is flowable with hydraulic fluid which is oil in this embodiment.

The supply connection P is arranged at a housing face of the valve housing 2 which housing face is oriented towards the internal combustion engine. In order to prevent a back flow of the hydraulic fluid from the valve housing 2 to the supply connection P a check valve 13 is arranged in the inflow channel 12. The check valve 13 is configured as a ball check valve and fixated in the valve housing 2 by a retaining element 29 configured as a Seeger ring and by a form element 47 wherein the retaining element is axially supported at a first annular shoulder 28 configured in a supply channel 12.

Figure 2:
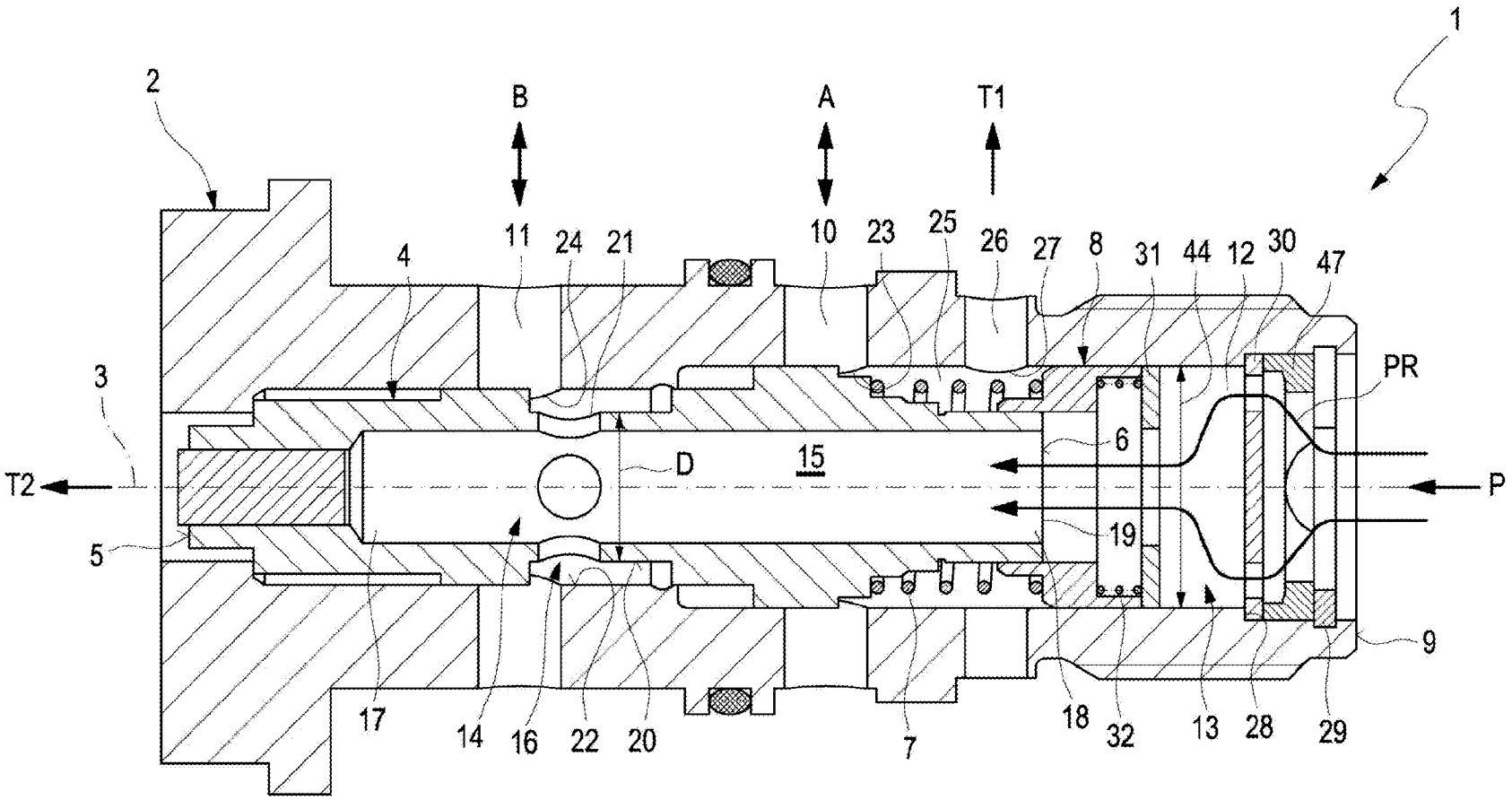
FIG. 2 illustrates a longitudinal sectional view of a hydraulic valve according to the invention.
Figure 3:
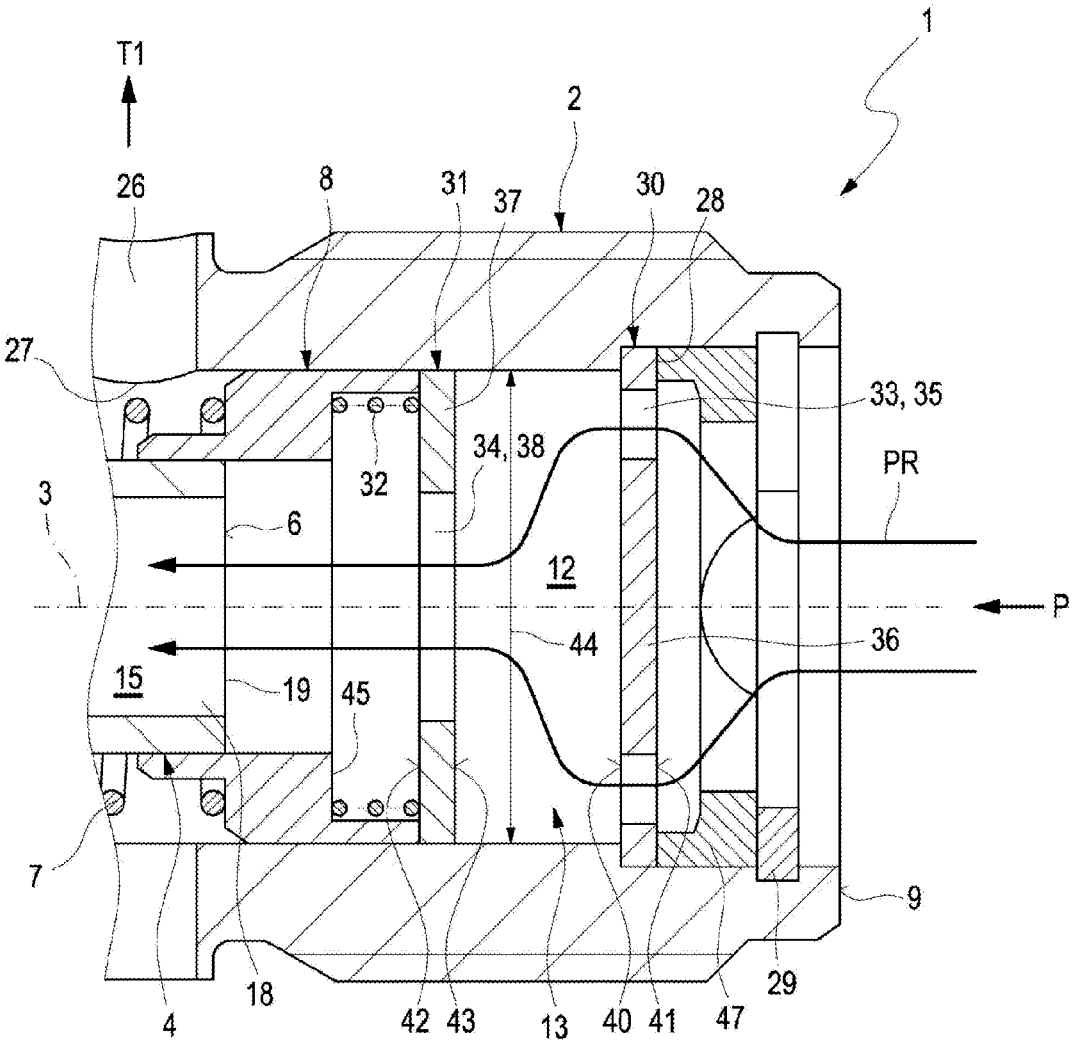
FIG. 3 illustrates a longitudinal sectional view of the hydraulic valve according to the invention according to FIG. 2.

A hydraulic valve 1 according to the invention is configured according to FIG. 2. A detail drawing for illustrating the check valve 13 depicts a longitudinal sectional view of a detail of the hydraulic valve 1 according to the invention in FIG. 3. The check valve 13 is configured disc shaped including a first disc shaped closure element 30 which is fixated in the inflow channel 12 downstream of the supply connection P in the valve housing. Between the valve piston 4 and the first closure element 30 a disc shaped second closure element is moveably received in the inflow channel 12. The first closure element 30 is configured independent from the second closure element 31. The two closure elements 30, 31 are positioned in the inflow channel 12 so that a first inflow surface 40 of the first closure element 30 and a second inflow surface 41 of the first closure element 30 which is oriented away from the first inflow surface 40 or a third inflow surface 42 of the second closure element 31 and a fourth inflow surface 43 of the second closure element 31 that is oriented away from the third inflow surface 42 are oriented parallel to a flow cross section 44 of the inflow channel 12.

The first closure element 30 is secured against axial movement by the first annular shoulder 28 in the inflow channel 12 and by the retaining element 29 and the formed element 47. Additionally a radial rotation of the first closure element 30 is blocked through a press fit of the first closure element 30 in the inflow channel 12.

Like typical check valves the check valve 13 opens when a pressure of the hydraulic fluid upstream of the check valve 13 is greater than a pressure downstream of the check valve 13 wherein the flow direction is counted from the direction of the supply connection P. FIG. 2 illustrates the hydraulic valve 1 according to the invention in a position in which the check valve 13 is flowable.

The hydraulic fluid presses the second closure element 31 against the hollow cylinder 8 where it is supported. A spring element 32 supported at the hollow cylinder 8 by a second shoulder 45 configured in the hollow cylinder 8 is arranged oriented towards the second closure element 31 for establishing contact and is preloaded in this position.

In closed condition the hydraulic fluid can flow in arrow direction PR from the supply connection P through a first pass through opening 33 of the first closure element 30 into the inflow channel 12 and from there through the second closure element 31 through its second pass through opening 34 so that the hydraulic fluid can enter the supply channel 15 through the hollow cylinder 8.

When sizing the second pass through opening 34 care has to be taken that its diameter is on the one hand side smaller than a smallest diameter configured in the hollow cylinder 8 and on the other hand side that it is large enough so that the hydraulic fluid can flow into the valve piston 4 in a sufficiently short time period also at high engine speeds. The advantage of sizing the diameter of the second pas through opening 34 smaller is that hydraulic fluid flowing out of the valve piston 4 in a direction towards the check valve 13 at least partially directly impacts the third inflow surface 42 and can move the third inflow surface against the first closure element 30 so that closing the check valve 13 is accelerated.

Figure 4:
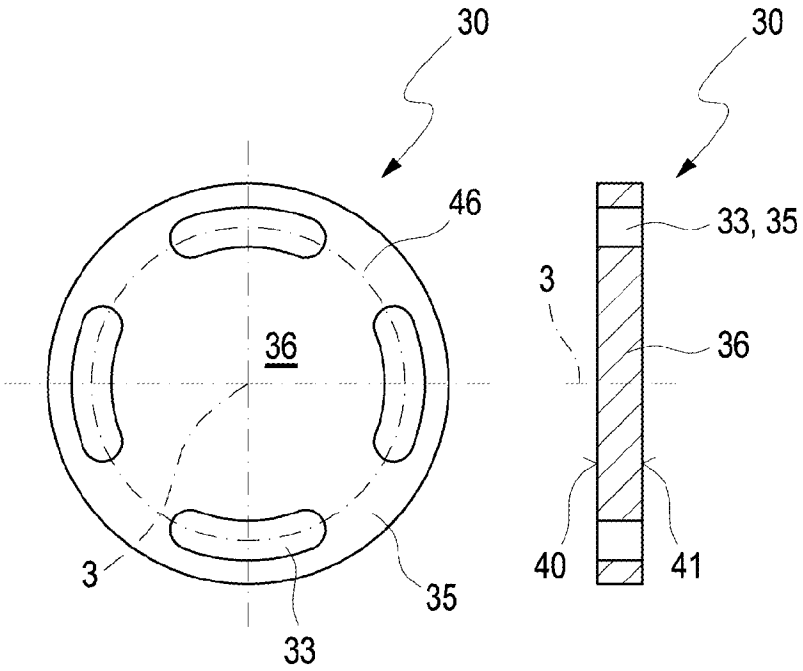
FIG. 4 illustrates a top view and a longitudinal sectional view of a first closure element of a check valve of the hydraulic valve according to FIG. 2.

The first pass through opening 33 is configured in an annular first outer section 35 of the first closure element 30, wherein the term "outer section" is thus interpreted so that a radial distance of the outer section 35 from a center of the first closure element 30 is greater than a radial distance of the first inner section 36 of the first closure element 30. The first pass through opening 33 is divided into four pass through opening sections by bars 46, wherein the bars 46 are required to implement a simple configuration of the first closure element 30 and are only used for defining the first pass through opening 33 in radial direction. The first pass through opening 33 is configured groove shaped providing an effective flow cross section with maximum size in the first outer section 35, c.f. FIG. 4.

Figure 5:
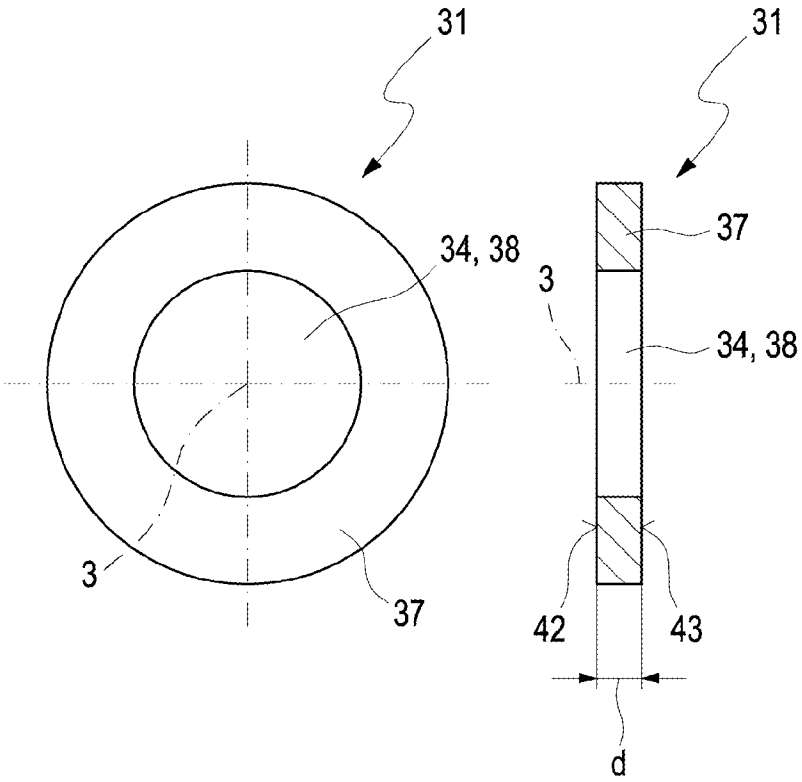
FIG. 5 illustrates a top view and a longitudinal sectional view of the check valve of the hydraulic valve according to FIG. 2.

The second closure element 31 is configured not flowable in its second outer section 37, wherein its second inner section 38 is flowable and includes the circular second pass through opening 34. Put differently the second closure element 31 is configured as a circular disc, cf. FIG. 5.

The pass through openings 33, 34 are arranged to that the first pass through opening 33 is arranged opposite to the non flowable second outer section 37 and the second pass through opening 34 is arranged opposite to the un flowable first section 36.

In case a pressure downstream of the check valve 13 is greater than a pressure upstream of the check valve 13 or in case a pressure spike due to cam phasing moments downstream of the check valve 13 impacts the second closure element 31, the second closure element 31 is pressed onto the first closure element 30 through a force of the pressure spike impacting a third inflow surface 42 of the second closure element 31 oriented towards the valve piston 4, so that accordingly positioned pass through openings 33, 34 are blocked by the respective other closure element 31, 30 so that they are not flowable.

The axially moveable second closure element 31 is supported in a sliding bearing in a radial direction at its circumference in the inflow channel 12 so that a wear caused by cavitation or abrasion is very small depending on an axial thickness d of the second closure element 31. The axial thickness d can be kept very small since the second closure element 31 performing its sealing function only has to cover the first pass through openings 33 with a fourth inflow surface 43 of the second closure element since the second closure element 31 is pressed against the first closure element 30 due to a pressure acting downstream.

The shape of the first closure element 30 and of the second closure element 31 illustrated in this embodiment and of the accordingly configured pass through openings 33, 34 facilitates advantageous sizing of the pass through openings 33, 34 so that sufficient hydraulic fluid can flow from the supply connection P into the valve piston 4 also under high engine speeds so that a quick response of the hydraulic valve 1 or a quick reaction time or switching time is implemented.

It is also favorable for a quick reaction time to use appropriate materials to implement a low weight of the moveable second closure element 31.

The spring element 32 supports the axial movement of the second closure element 31 and presses the second closure element 31 against the first closure element 30 which supports safe closure. Using the spring element 32 significantly improves responsiveness of the hydraulic valve 1 due to improved dynamics of the check valve 13 over known check valves. Additionally the spring element 32 helps to dampen pressure spikes which can occur in the inflow channel 12 coming from the supply connection P and thus achieves loading the valve piston 4 by the hydraulic fluid without pressure spikes.

Figure 6:
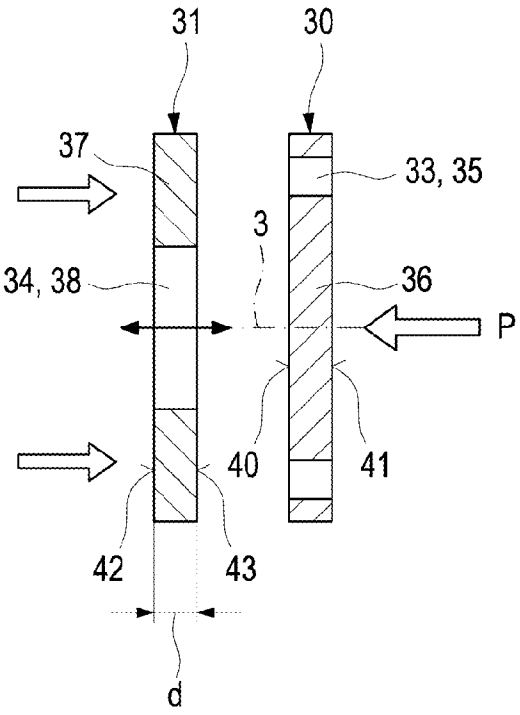
FIG. 6 illustrates a view in principle of the first closure element and the second closure element according to FIGS. 4 and 5 in a longitudinal sectional view in a first relative position.

FIG. 6 illustrates the first closure element 30 and the second closure element 31 in a longitudinal sectional view in a first relative position. Depending on the pressures applied at the check valve 13 the second closure element 31 moves in an axial direction. When a pressure caused by pressure spikes on a side of the check valve 13 is greater than a pressure on a side of the supply connection P the second closure element 31 impacts the first closure element 30 until a sealing contact is established between the first closure element 30 and the second closure element 31.

Figure 8:
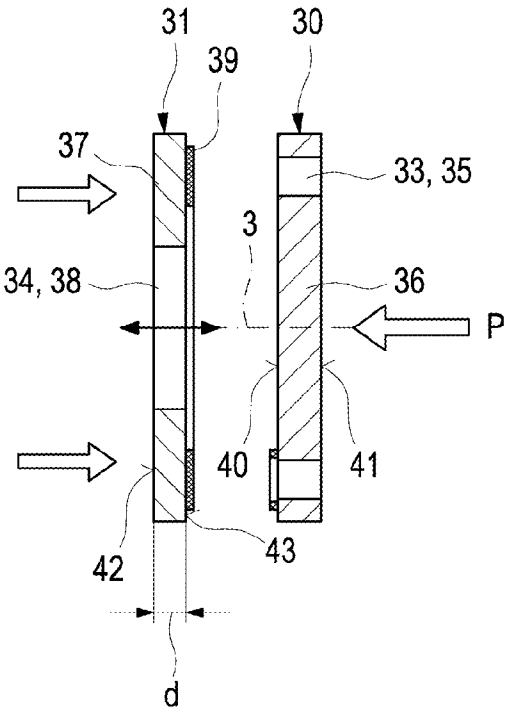
FIG. 8 illustrates a view in principle of the first closure element and the second closure element in a third embodiment in the second relative position.
Figure 7:
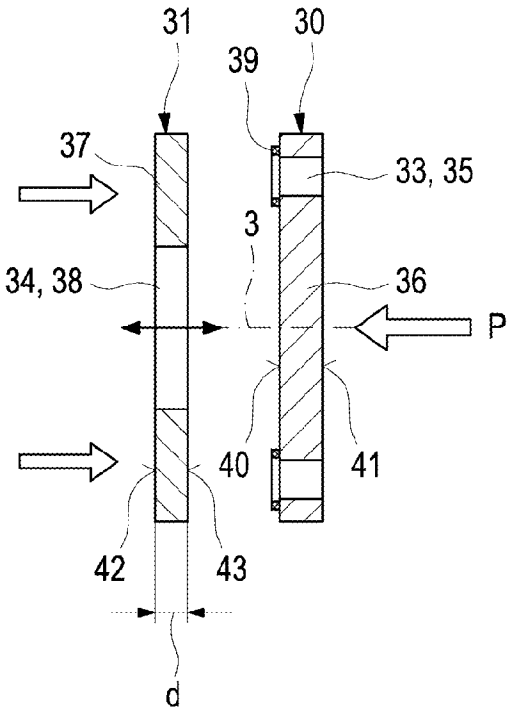
FIG. 7 illustrates a view in principle of the first closure element and the second closure element in a longitudinal sectional view in a second embodiment in a second relative position.

Improved sealing of the check valve 13 can be achieved by a seal element 39 between the first closure element 30 and the second closure element 31. According to a second embodiment, c.f. FIG. 7 the seal element 39 is configured at the first inflow surface 40 arranged opposite to the second closure element 31. By the same token the sealing element 39 can be arranged at a fourth inflow surface 43 arranged opposite to the first closure element 30 as illustrated in the third embodiment according to FIG. 8.

REFERENCE NUMERALS AND DESIGNATIONS

1 hydraulic valve
2 valve housing
3 longitudinal axis
4 valve piston
5 first face
6 second face
7 retaining element
8 hollow cylinder
9 housing face
10 first channel
11 second channel
12 inflow channel
13 check valve
14 channel system
15 supply channel
16 channel group
17 first channel end
18 second channel end
19 inlet opening
20 enveloping surface
21 outlet opening
22 inner surface
23 first opening
24 second opening
25 first gap
26 third channel
27 third opening
28 first shoulder
29 safety element
30 first closure element
31 second closure element
32 spring element
33 first pass through opening
34 second pass through opening
35 first outer section
36 first inner section
37 second outer section
38 second inner section
39 sealing element
40 first inflow surface
41 second inflow surface
42 third inflow surface
43 fourth inflow surface
44 flow cross section
45 second shoulder
46 bar
47 form element
A first operating connection
B second operating connection
D diameter D1 first diameter
D2 second diameter
P supply connection
PR arrow direction
T1 first tank access
T2 second tank access
d thickness

What is claimed is:

1. A hydraulic valve for a cam phaser, the hydraulic valve comprising:

a valve housing with a longitudinal axis and a valve piston that is axially moveable along the longitudinal axis, wherein the valve piston opens and closes a first operating connection of the valve housing and a second operating connection of the valve housing, wherein the first operating connection and the second operating connection are axially offset from one another; and a supply connection of the valve housing which is used for supplying the hydraulic valve with a hydraulic fluid fed by a feed device, wherein the hydraulic valve is configured to be flowed through by the hydraulic fluid on different paths controlled by a flow permeable channel system of the valve piston, and wherein a check valve opening and closing an inflow channel is arranged in the hydraulic valve in the inflow channel of the valve housing which inflow channel is associated with the supply connection, wherein the check valve includes a disc shaped flow permeable first closure element with a first pass through opening and a spring element, wherein the check valve includes a flow permeable second closure element with a second pass through opening, wherein the first pass through opening is arranged opposite to a non flow permeable second outer section of the second closure element, wherein the second pass through opening is arranged opposite to a non flow permeable first inner section of the first closure element, so that a relative movement between the first closure element and the second closure element causes an opening or closing of the check valve, and wherein the spring presses the second closure element against the first closure element in a closed condition of the check valve.

2. The hydraulic valve according to the claim 1, wherein the first closure element is configured independent from the second closure element.

3. The hydraulic valve according to the claim 1, wherein the first closure element is configured non moveable and the second closure element is configured moveable.

4. The hydraulic valve according to claim 1, wherein the second closure element is configured axially moveable along the longitudinal axis.

5. The hydraulic valve according to claim 1, wherein the second closure element is configured disc shaped.

6. The hydraulic valve according to claim wherein the first pass through opening is configured in an outer section of the first closure element and the second pass through opening is configured in a second inner section of the second closure element.

7. The hydraulic valve according to claim 1, wherein a first shoulder is configured in the inflow channel for axially securing the first closure element.

8. The hydraulic valve according to claim 1, wherein a seal element is configured at a first inflow surface of the first closure element which first inflow surface is arranged opposite to the second closure element or at a fourth inflow surface of the second closure element, which fourth closure surface is arranged opposite to the first closure element.

9. The hydraulic valve according to claim 1, wherein the first pass through opening is configured groove shaped and the second pass through opening is configured circular.

10. The hydraulic valve according to claim 1, wherein an axial movement of the first closure element or of the second closure element is supported by the spring element.

11. The hydraulic valve according to claim 1, wherein a seal element is configured at a first inflow surface of the first closure element which first inflow surface is arranged opposite to the second closure element and at a fourth inflow surface of the second closure element, which fourth closure surface is arranged opposite to the first closure element.

* * * * *